US007018171B2

(12) United States Patent
Wang et al.

(10) Patent No.: US 7,018,171 B2
(45) Date of Patent: Mar. 28, 2006

(54) BLOWER WITH DOUBLE INLET WHEEL

(75) Inventors: Chun Wang, Brampton (CA); Enzo Iantorno, Brampton (CA)

(73) Assignee: Airex Inc., Brampton (CA)

( * ) Notice: Subject to any disclaimer, the term of this patent is extended or adjusted under 35 U.S.C. 154(b) by 113 days.

(21) Appl. No.: 10/762,324

(22) Filed: Jan. 23, 2004

(65) Prior Publication Data

US 2005/0163607 A1 Jul. 28, 2005

(51) Int. Cl.
*F01D 31/02* (2006.01)

(52) U.S. Cl. ..... 415/98; 415/102; 415/121.1; 416/184

(58) Field of Classification Search ..... 415/98, 415/101, 102, 121.2; 416/184, 175, 203
See application file for complete search history.

(56) References Cited

U.S. PATENT DOCUMENTS

| | | | | |
|---|---|---|---|---|
| 978,397 | A * | 12/1910 | Rice | 415/98 |
| 3,246,605 | A * | 4/1966 | Fisher | 415/90 |
| 3,805,542 | A | 4/1974 | Hosoda et al. | |
| 4,102,596 | A | 7/1978 | Itayama | |
| 4,102,597 | A | 7/1978 | Itayama | |
| 4,817,708 | A | 4/1989 | Ono et al. | |
| 4,902,199 | A * | 2/1990 | McDonald et al. | 415/143 |
| 5,864,190 | A | 1/1999 | Bacchiocchi | |
| 6,004,093 | A * | 12/1999 | Ishikawa | 415/98 |
| 6,030,173 | A | 2/2000 | Bacchiocchi | |
| 6,136,055 | A * | 10/2000 | Stanek | 55/357 |
| 6,308,770 | B1 | 10/2001 | Shikata et al. | |
| 6,530,743 | B1 * | 3/2003 | Barrett | 415/101 |
| 2002/0119044 | A1 | 8/2002 | O'Connor, Jr. et al. | |

* cited by examiner

*Primary Examiner*—Edward K. Look
*Assistant Examiner*—Igor Kershteyn
(74) *Attorney, Agent, or Firm*—Ogilvy Renault LLP; Paul J. Field

(57) ABSTRACT

A blower having an enclosure having side walls defining an internal chamber, an open end comprising a first inlet, a second inlet and an outlet. A flow separator plate extends across the internal chamber between the side walls defining a first scroll duct and a second scroll duct. The first scroll duct is in flow communication with the first inlet and the outlet, while the second scroll duct is in flow communication with the second inlet and the outlet. A blower wheel is rotatably mounted in the enclosure through an opening in the separator plate having a first wheel portion disposed in the first scroll duct and a second wheel portion disposed in the second scroll duct.

3 Claims, 3 Drawing Sheets

BLOWER WITH DOUBLE INLET WHEEL

TECHNICAL FIELD

The invention relates to a dual blower with a double inlet wheel in an enclosure with two inlets and a single outlet.

BACKGROUND OF THE ART

The invention is directed to dual blowers used for example in exhausting air from a room or series of rooms simultaneously. Since the most costly components of a blower are the electric motor and controls, it is desirable to use a single motor with dual blower wheels mounted on the motor shaft with separate ducting to each wheel rather than requiring separate fans for each inlet. In such an arrangement, the blower wheels may have different diameters and different heights in order to modify the blower characteristics to the quantity of flow air draw into each inlet as required.

Examples of dual blower systems are shown in U.S. Pat. No. 6,308,770 to Shikata et al., U.S. Pat. No. 2002/0119044 to Connor Jr. et al. and U.S. Pat. No. 6,030,173 to Bacchiocchi.

A disadvantage of the prior art is that the housing, blower and blower motor are often difficult to access for inspection and maintenance as well as initial installation and wiring.

The present invention provides a dual wheel blower having a simplified scroll enclosure wherein the mechanical and electrical components of the blower are easily access through a removable grate.

Further features of the invention will be apparent from review of the disclosure, drawings and description of the invention below.

DISCLOSURE OF THE INVENTION

The invention provides a blower having an enclosure with side walls defining an internal chamber, an open end forming a first inlet, a second inlet and a single combined outlet. A flow separator plate extends across the internal chamber between the side walls defining a first scroll duct and a second scroll duct. The first scroll duct is in flow communication with the first inlet and the outlet, whereas the second scroll duct is in flow communication with the second inlet and the outlet. A blower wheel is rotatably mounted in the enclosure through an opening in the separator plate having a first wheel portion disposed in the first scroll duct and a second wheel portion disposed in the second scroll duct.

DESCRIPTION OF THE DRAWINGS

In order that the invention may be readily understood, one embodiment of the invention is illustrated by way of example in the accompanying drawings.

Figure 1:
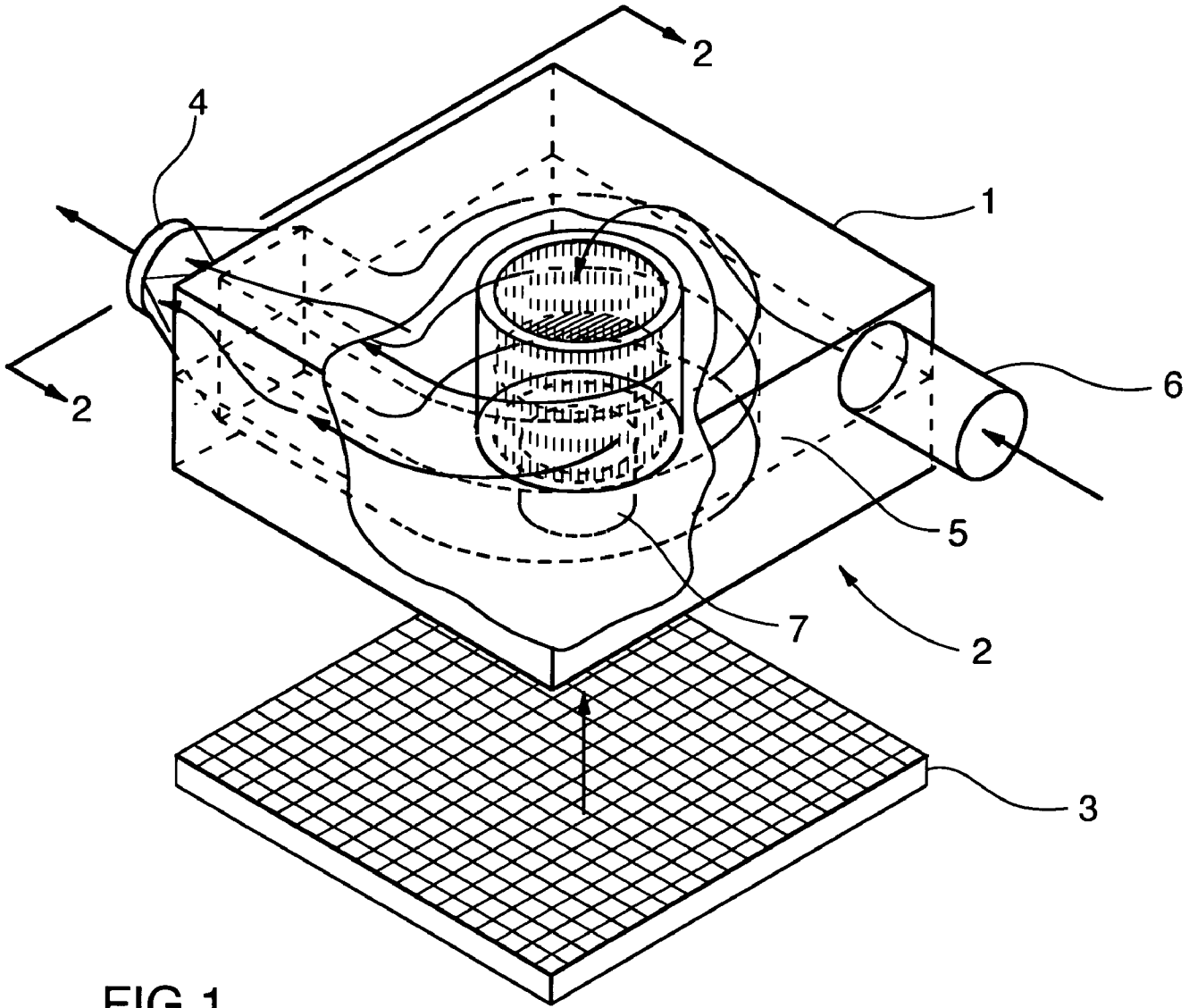
FIG. 1 is an exploded perspective view of a blower enclosure with a horizontal flow separator plate and double blower wheel rotatably mounted about a vertical axis where the open bottom end of the enclosure provides a first air inlet, a second inlet extends from an upper portion of the enclosure, and a combined outlet receives the output from the dual blower wheels.

Further details of the invention and its advantages will be apparent from the detailed description included below.

DETAILED DESCRIPTION OF PREFERRED EMBODIMENTS

The blower comprises an enclosure 1 having sidewalls defining an internal chamber with an open end 2 within which a removable grate 3 is positioned to provide a first inlet. The enclosure 1 is mounted within a ceiling in order to intake air through the grate 3 and expel the air through the outlet 4.

A flow separator plate 5 extends across the internal chamber of the enclosure 1 between side walls. Air inlet through the grate 3 and the open end 2 is separated by the flow separator plate 5 from air that is drawn through the second inlet 6 into the upper portion of the enclosure 1 and is also exhausted through the combined outlet 4. A blower according to the invention may be used for example in a home where the enclosure 1 is mounted in the ceiling of the first bathroom whereas the second inlet 6 is ducted to an intake vent in a second bathroom. Therefore, an advantage of the invention is that only one electrical connection is required and the expense of two separate motors and two separate fan assemblies can be avoided, substantially reducing the cost of venting a second or more rooms or areas in the same room. A further advantage is that by removing the grate 3, the electric motor 7 and blower may be removed or installed as required. Electrical connections can be inspected and installed after the enclosure 1 has been mounted in the ceiling.

Figure 2:
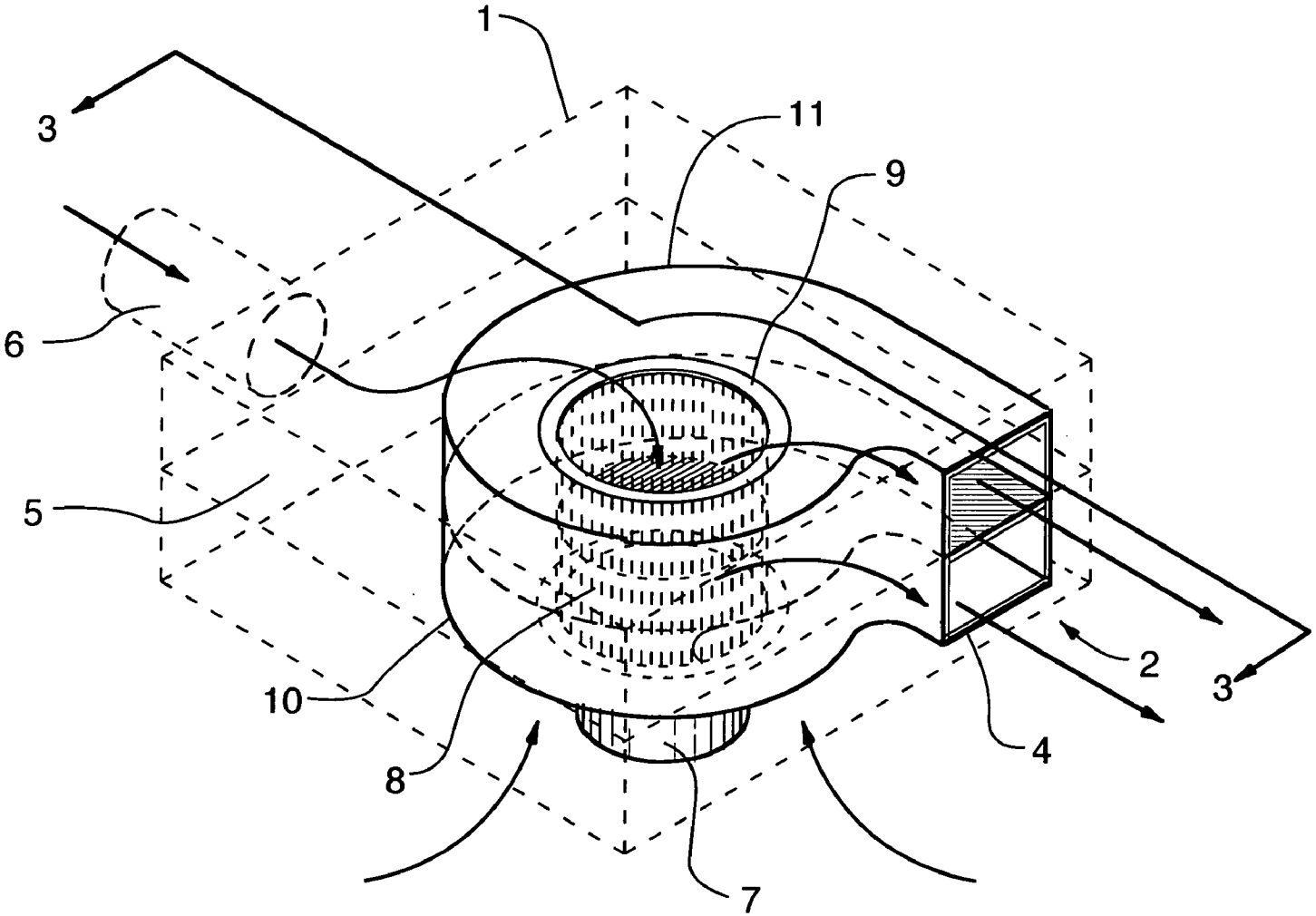
FIG. 2 is a like perspective view shown from the view of 2—2 on FIG. 1 showing the arrangement of the dual blower wheels housed within a scroll duct.
Figure 3:
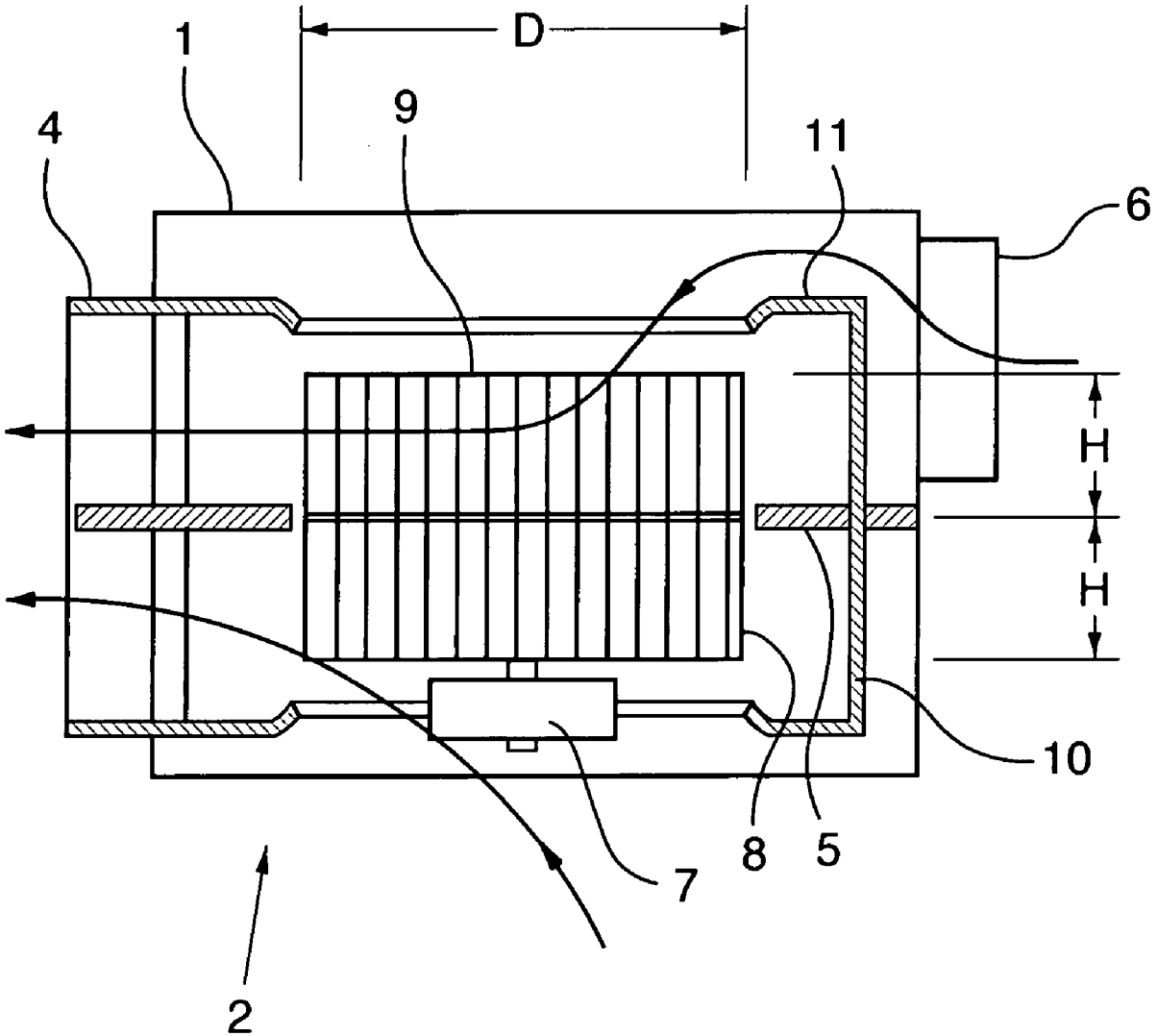
FIG. 3 is a vertical section view along line 3—3 as indicated in FIG. 2.

Turning to FIGS. 2 and 3, the flow separator plate 5 includes an opening through which the blower wheel extends and is rotatable mounted in the enclosure 1, a first wheel portion 8 is disposed in a first scroll duct 10. The first scroll duct 10 is in flow communication with the first inlet (provided by the open end 2 in the enclosure 1) and the outlet 4.

A second wheel portion 9 is disposed in a second scroll duct 11. The second scroll duct 11 is in flow communication between the second inlet 6 and the outlet 4. As best seen in FIG. 3, the flow separator plate 5 extends across the internal chamber between the sidewalls of the enclosure 1 and serves to define the separation between the first scroll duct 10 and the second scroll duct 11.

An advantage of the invention is that the blower wheel comprising the first wheel portion 8 and the second wheel portion 9 may have different diameters "D" and different heights "H" in order to accommodate different rates of flow required as air is drawn into the first inlet open 2 and second inlet 6. Advantageously, the first wheel portion 8 and second wheel portion 9 can be manufactured separately and then bolted together before connection with the motor 7 in order to easily manufacture the assembly and adapt for different blower capacities. The first scroll duct 10 and second scroll duct 11 can also be manufactured separately and assembled together in a like matter.

Although the above description relates to a specific preferred embodiment as presently contemplated by the inventor, it will be understood that the invention in its broad aspect includes mechanical and functional equivalents of the elements described herein.

We claim:

1. A blower comprising:

an enclosure having side walls defining an internal chamber, an open end comprising a first inlet, a second inlet and an outlet, wherein the open end of the enclosure includes a removable grate;

a flow separator plate extending across the internal chamber between the side walls defining a first scroll duct and a second scroll duct, the first scroll duct being in flow communication with the first inlet and the outlet, the second scroll duct being in flow communication with the second inlet and the outlet; and a blower wheel rotatably mounted in the enclosure through an opening in the separator plate having a first wheel portion disposed in the first scroll duct and a second wheel portion disposed in the second scroll duct wherein the blower wheel is accessible and removable through the open end of the enclosure.

2. The blower according to claim 1 wherein the first wheel portion has a diameter different from a diameter of the second wheel portion.

3. The blower according to claim 1 wherein the first wheel portion has a height different from a height of the second wheel portion.

* * * * *